US008328249B2

(12) United States Patent
Corrales et al.

(10) Patent No.: US 8,328,249 B2
(45) Date of Patent: Dec. 11, 2012

(54) VEHICLE LATCH

(75) Inventors: Manuel Corrales, Chihuahua (MX); Eduardo Estrada, Chihuahua (MX); Joseph Long, Waterford, MI (US); David W. Achinger, Sterling Heights, MI (US)

(73) Assignee: Inteva Products, LLC, Troy, MI (US)

( * ) Notice: Subject to any disclaimer, the term of this patent is extended or adjusted under 35 U.S.C. 154(b) by 501 days.

(21) Appl. No.: 12/470,953

(22) Filed: May 22, 2009

(65) Prior Publication Data

US 2009/0295174 A1 Dec. 3, 2009

Related U.S. Application Data

(60) Provisional application No. 61/056,423, filed on May 27, 2008.

(51) Int. Cl.
*E05C 3/06* (2006.01)
*E05C 3/00* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS 5,934,717 A 8/1999 Wirths et al.
5,938,253 A * 8/1999 Szablewski et al. ..... 292/216
6,076,868 A 6/2000 Roger, Jr. et al.
6,145,354 A 11/2000 Kondo et al.
6,155,124 A * 12/2000 Wirths ..... 74/89.13
6,390,517 B1 * 5/2002 Ehret ..... 292/201
6,557,910 B2 5/2003 Amano
6,565,131 B2 * 5/2003 Roos ..... 292/201
6,565,132 B2 5/2003 Mork et al.
6,863,318 B2 * 3/2005 Mejean et al. ..... 292/201
7,032,937 B2 * 4/2006 Boecker et al. ..... 292/201
7,140,651 B2 * 11/2006 Brose ..... 292/216
7,192,066 B2 3/2007 Ilea et al.
7,234,736 B2 * 6/2007 Kachouh ..... 292/201

OTHER PUBLICATIONS

Written Opinion dated Jan. 5, 2010 for PCT/US2009/044998, International Filing Date May 22, 2009.
International Search Report dated Jan. 5, 2010 for PCT/US2009/044998, International Filing Date May 22, 2009.

* cited by examiner

*Primary Examiner* — Carlos Lugo
(74) *Attorney, Agent, or Firm* — Cantor Colburn LLP

(57) ABSTRACT

A latch assembly is provided, the latch assembly having a fork bolt movably secured thereto for movement between a latched position and an unlatched position. A detent lever is also provided. The detent lever is capable of movement between an engaged position and a disengaged position, wherein the detent lever retains the fork bolt in the latched position when the detent lever is in the engaged position. The detent lever has a stop member and a guide member each protruding away from a surface of the detent lever and the stop member is in a spaced relationship with respect to the guide member. The latch assembly also includes an actuator for moving the detent lever from the engaged position to the disengaged position by contacting the guide member while the stop member is positioned so that the actuator will contact the stop member and prevent further movement of the actuator when the fork bolt is in the unlatched position and the detent lever is in the disengaged position.

15 Claims, 6 Drawing Sheets

VEHICLE LATCH

CROSS REFERENCE TO RELATED APPLICATIONS

The present application claims the benefit of U.S. Provisional Patent Application Ser. Nos. 61/056,423 filed May 27, 2008, the contents of which are incorporated herein by reference thereto.

BACKGROUND

Exemplary embodiments of the present invention relate to door, lift gate, glass window and movable panel latches and, more particularly, to latches for vehicles.

A vehicle frequently includes displaceable panels such as doors, windows, hood, trunk lid, hatch and the like which are affixed for hinged or sliding engagement with a host vehicle body. Cooperating systems of latches and strikers are typically provided to ensure that such panels remain secured in their fully closed position when the same is closed.

A latch typically includes a fork bolt that is pivoted between an unlatched position and a primary latched position when the door is closed to latch the door in the closed position. The fork bolt is typically held in the primary latched position by a detent lever that pivots between an engaged position and a disengaged position. The detent lever holds the fork bolt in the primary latched position when in the engaged position and releases the fork bolt when in the disengaged position so that the door can be opened.

The fork bolt is pivoted to the primary latched position by a striker attached to, for example, an associated doorjamb, lift gate, moveable member such as a window etc., when the same is closed. Once in the primary latched position, the detent lever engages the fork bolt to ensure the assembly remains latched.

Accordingly, it is desirable to provide an automatically operated door latch assembly. More specifically, it is desirable to provide an automatically operated door latch assembly that employs a device or motor to move the detent lever from the engaged position to the disengaged position in order to release the striker from the fork bolt.

SUMMARY OF THE INVENTION

In accordance with an exemplary embodiment of the invention, a latch assembly is provided. The latch assembly has a fork bolt movably secured thereto for movement between a latched position and an unlatched position. A detent lever is also provided. The detent lever is capable of movement between an engaged position and a disengaged position, wherein the detent lever retains the fork bolt in the latched position when the detent lever is in the engaged position. The detent lever has a stop member and a guide member each protruding away from a surface of the detent lever. The stop member is in a spaced relationship with respect to the guide member. The latch assembly also includes an actuator for moving the detent lever from the engaged position to the disengaged position by contacting the guide member while the stop member is positioned so that the actuator will contact the stop member and prevent further movement of the actuator when the fork bolt is in the unlatched position and the detent lever is in the disengaged position.

In accordance with another exemplary embodiment of the present invention, a method of operating a latch assembly is provided, the method comprising: rotating a fork bolt into a latched position from an unlatched position; engaging a detent lever with the fork bolt when the fork bolt is in the latched position; releasing the detent lever from the fork bolt by rotating an actuator until it engages a guide member of the detent lever and moves the detent lever into the a disengaged position with respect to the fork bolt; rotating the fork bolt from the latched position to the unlatched position; and preventing the actuator from contacting the guide member by locating a stop member on the detent lever such that rotation of the actuator in a first direction is limited by the stop member when the detent lever is in the disengaged position.

Additional features and advantages of the various aspects of exemplary embodiments of the present invention will become more readily apparent from the following detailed description in conjunction with the drawings wherein like reference numerals refer to corresponding parts in the several views.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION OF EXEMPLARY EMBODIMENTS

Exemplary embodiments of the present invention relate to an apparatus and method for providing a latch assembly. Furthermore, exemplary embodiments are directed to a latch assembly having a fork bolt movably secured thereto for movement between a latched position and an unlatched position. The latch assembly further comprises a detent lever capable of movement between an engaged position and a disengaged position, wherein the detent lever retains the fork bolt in the latched position when the detent lever is in the engaged position. The detent lever has a stop member and a guide member each protruding away from a surface of the detent lever and the stop member is in a spaced relationship with respect to the guide member. The latch assembly also includes an actuator for moving the detent lever from the engaged position to the disengaged position by contacting the guide member. The stop member is positioned so that the actuator will contact the stop member and prevent further movement of the actuator when the fork bolt is in the unlatched position and the detent lever is in the disengaged position.

References made to the following U.S. patents: U.S. Pat. Nos. 5,934,717; 6,076,868; 6,565,132; and 7,192,066 the contents each of which are incorporated herein by reference thereto.

Figure 1:
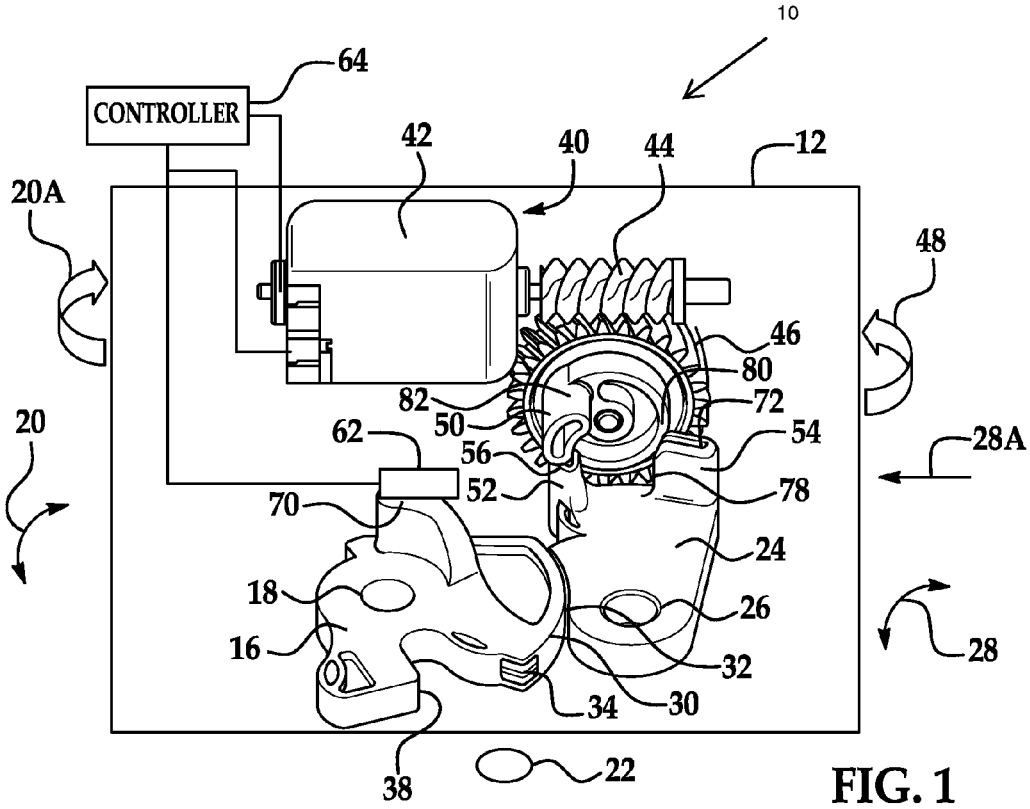
FIG. 1 is a perspective view illustrating a latch assembly in an open position in accordance with an exemplary embodiment of the present invention.
Figure 2:
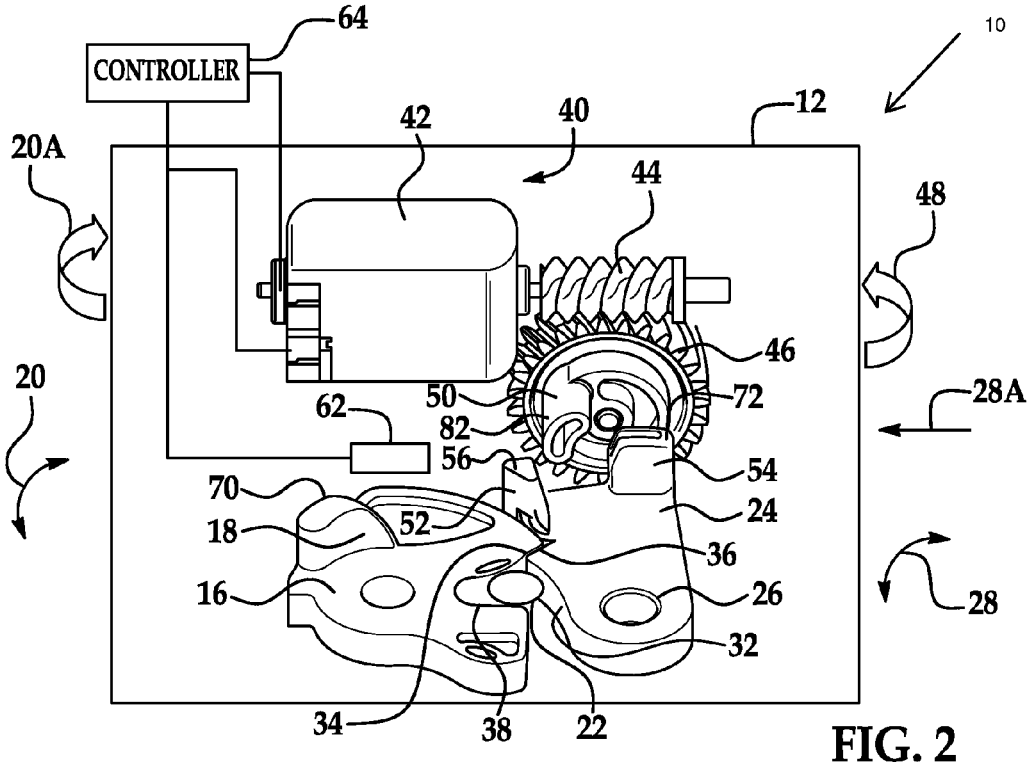
FIG. 2 is a perspective view illustrating the latch assembly of FIG. 1 in a closed position.
Figure 2A:
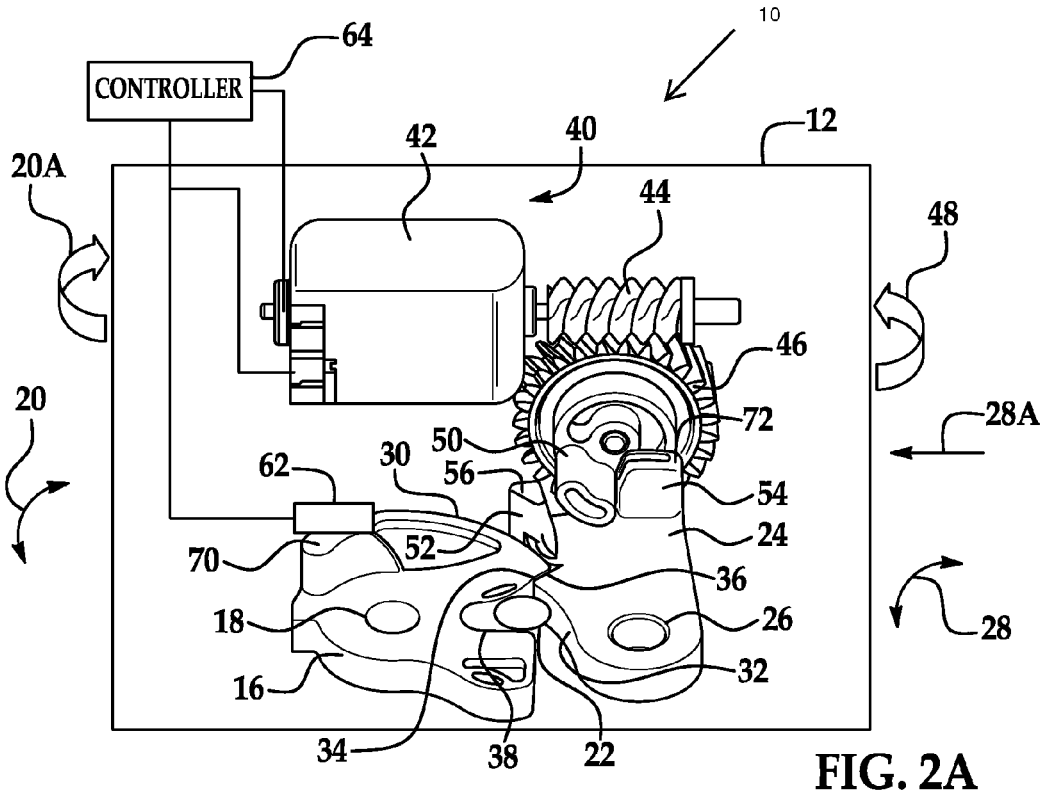
FIG. 2A-FIG. 2D are sequential views illustrating movement of the latch assembly from the closed position to the open position.
Figure 2B:
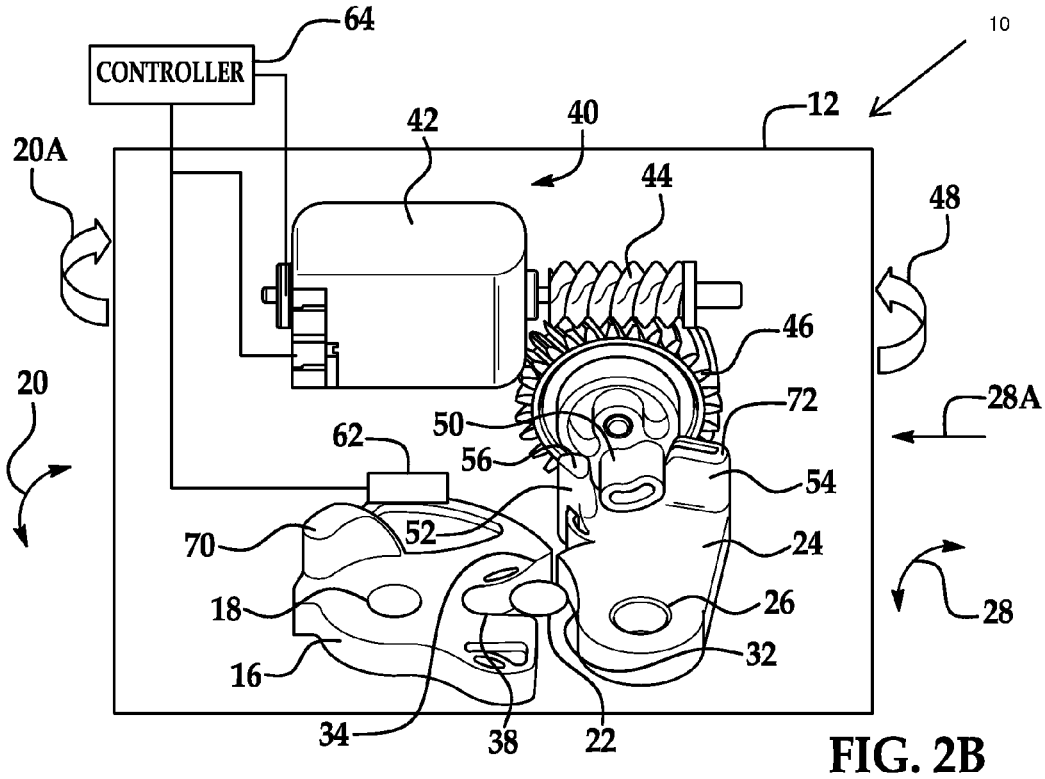
Figure 2C:
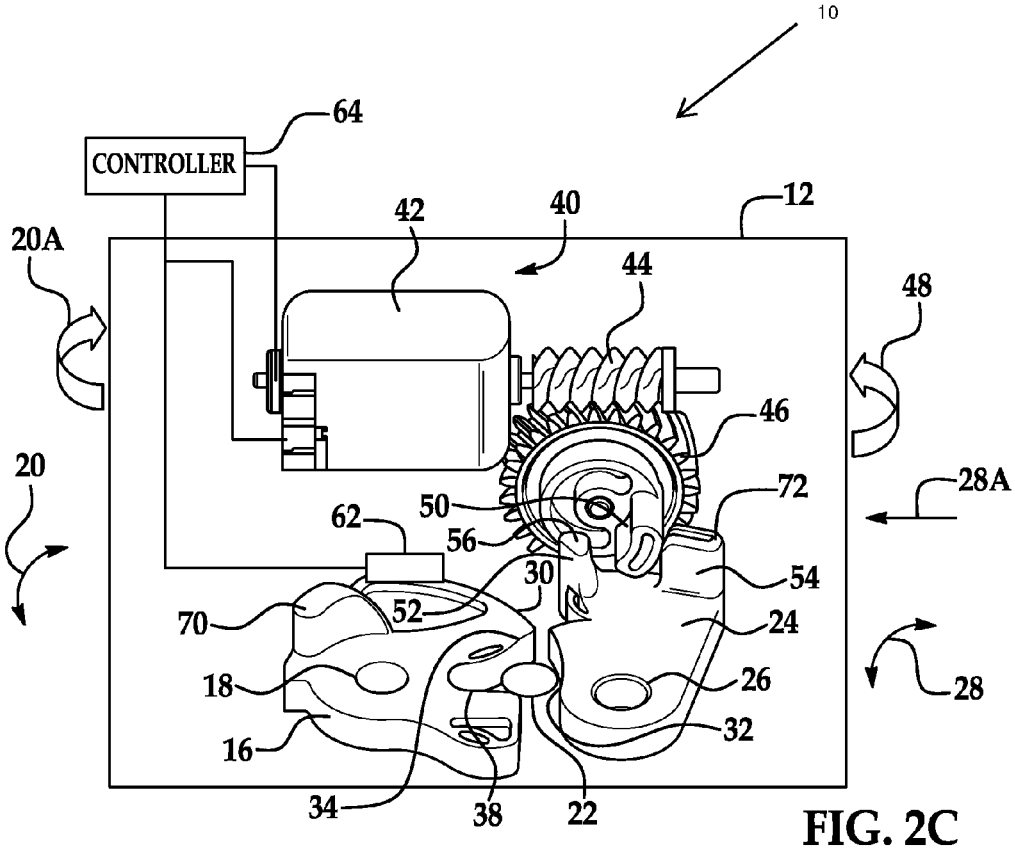
Figure 2D:
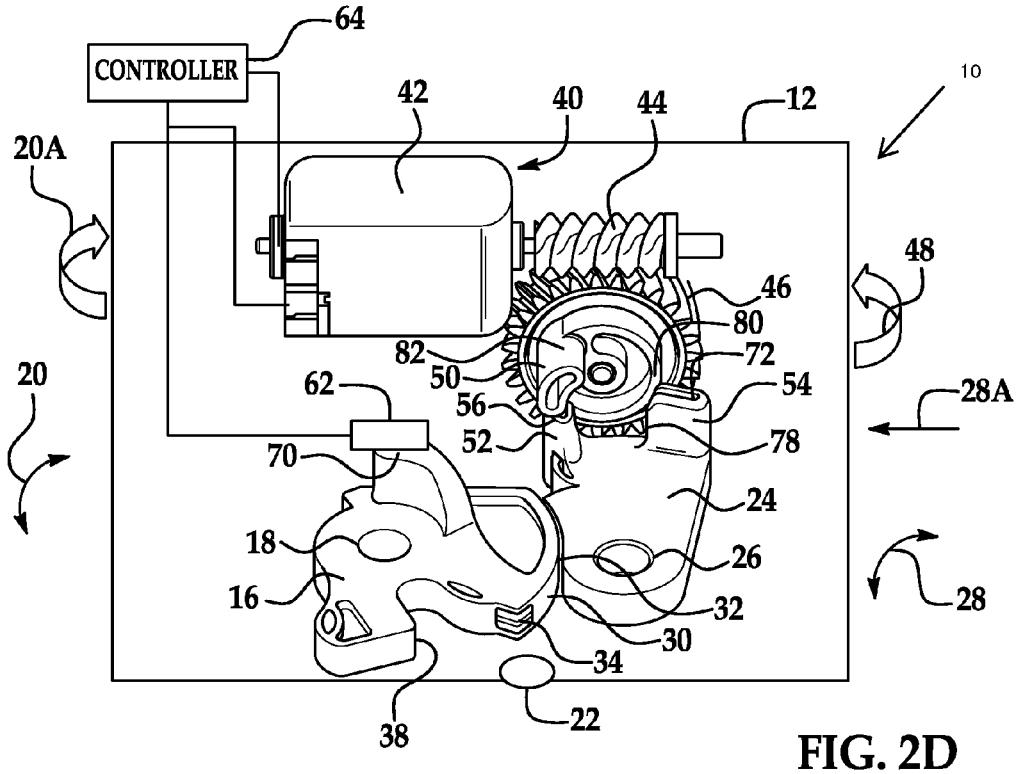

Referring now to FIGS. 1-2D a vehicle compartment latch or latch assembly 10 in accordance with an exemplary embodiment of the present invention is illustrated. In one embodiment, vehicle compartment latch 10 comprises a housing or support 12 that is adapted for fastening to a vehicle proximate to a compartment closure.

A fork bolt 16 is pivotally or rotationally mounted to support 12 about a pivot pin that is received within a pivot pin opening 18 of the fork bolt. Fork bolt 16 is capable of rotational movement between an open or unlatched position shown in FIG. 1 and a closed or latched position shown in FIG. 2, wherein the fork bolt rotates in the direction of arrows 20.

Vehicle compartment latch 10 is attached to a vehicle structure such that fork bolt 16 is moved between the open position shown in FIG. 1 and the closed position shown in FIG. 2 when a door, window, lift gate, etc. is opened and closed and fork bolt 16 engages a striker 22 (illustrated schematically) that is attached to the door, window, lift gate, etc. Alternatively, the vehicle compartment latch 10 is secured to the door, window, lift gate, etc. and the striker is secured to the vehicle body at an opening into which the door, window, lift gate, etc. is received. The cooperation of a fork bolt and striker is well known and need not be described in detail.

Vehicle compartment latch 10 further comprises a detent lever 24 that pivots on support 12 about a pivot pin received within a pivot pin opening 26 in the detent lever. The detent lever cooperates with fork bolt 16 in a well known manner to retain fork bolt 16 in the closed position shown in FIG. 2 or release the fork bolt 16 for return to the open position shown in FIG. 1. That is, detent lever 24 pivots between a closed or engaged detent position shown in FIG. 2 and a release or disengaged detent position shown in FIG. 1 in the direction of arrows 28. In accordance with an exemplary embodiment of the present invention, fork bolt 16 is spring biased clockwise to the open position shown in FIG. 1 or in the direction of arrow 20*a* by a biasing member (e.g., coil spring or other equivalent member) that has one end attached to fork bolt 16 and the other end attached to the housing or other equivalent location. Alternatively and/or in combination with the spring biasing force, the fork bolt can be rotated into the open position by the pulling of the striker as the enclosure of window is opened.

Similarly, a biasing member or spring will also bias the detent lever in the direction of arrow 28A counterclockwise against a face of fork bolt 16 as shown in the FIGS.

In accordance with exemplary embodiments of the present invention, the fork bolt has a surface 30 that slides along a complimentary surface 32 of the detent when the fork bolt rotates from the open position (FIG. 1) to the closed position (FIG. 2). Once in the closed position (FIG. 2), a shoulder portion 34 of the fork bolt engages a shoulder portion 36 of the detent lever thus engaging the fork bolt and securing it into the closed position when the striker is secured in a receiving opening 38 of the fork bolt. Once the latch is in the closed position the detent lever is spring biased in the direction of arrow 28A and shoulder 36 engages shoulder 34 such that the fork bolt cannot rotate into the open position unless the detent lever is moved back to the release or disengaged detent position (e.g., moving shoulder 36 away from shoulder 34 allowing the fork bolt to rotate in the direction of arrow 20A into the open position.

In order to overcome the biasing force in the direction of arrow 28A a motor assembly 40 is provided. Motor assembly 40 includes a motor 42 for driving a worm gear 44 configured and positioned to drive a gear or actuator 46. In accordance with an exemplary embodiment of the present invention, motor 42 is a unidirectional motor such that activation of the motor causes gear or actuator 46 to rotate in a single direction namely that of arrow 48 (e.g., clockwise). Gear 46 has a protrusion 50 that makes contact with a stop member 52 and/or a guide member 54 each protruding away from a surface of the detent lever. The stop member is in a spaced relationship with respect to the guide member. The stop member and the guide member are positioned such that when the fork bolt is in the open position illustrated in FIG. 1 and accordingly the detent lever is in the disengaged position rotation of gear or actuator 46 in the direction of arrow 48 will cause protrusion 50 to contact a top surface 56 of stop member 52. This contact (e.g., protrusion 50 hitting top surface 56) prevents gear or actuator 46 from further rotation in the direction of arrow 48. Accordingly and even if the motor is still energized, gear or actuator 46 cannot rotate once it has made contact with stop member 52.

Once the fork bolt rotates into the closed position illustrated in FIG. 2 detent lever 24 rotates in the direction of arrow 28A and shoulder portion 36 of the detent lever engages a complementary shoulder portion 34 of the fork bolt retaining the fork bolt in the closed position. In addition and now that the detent lever has rotated in the direction of arrow 28A, protrusion 50 is now located in the gap between stop member 52 and guide member 54. Accordingly, rotation of the gear or actuator in the direction of arrow 48 will now cause the protrusion to contact the guide member as the gear is rotated in the direction of arrow 48. This rotation will cause releasable movement of the latch assembly.

This release movement is illustrated in FIGS. 2A-2D wherein rotation of the gear in the direction of arrow 48 will cause the protrusion to contact the guide member (FIG. 2A), overcome the biasing force applied to the detent lever and rotate the detent lever in a direction opposite arrow 28A such that shoulder 36 no longer contacts shoulder 34 of the fork bolt (FIG. 2B) and the spring biasing force applied to the fork bolt causes the same to rotate into the open position from the closed position (FIGS. 1 and 2D). Furthermore, additional rotation of the gear or actuator in the direction of arrow 48 causes protrusion 50 to no longer contact guide member 54 and the biasing force applied to the detent lever in the direction of arrow 28A causes the detent lever to rotate back towards the fork bolt however shoulders (34, 36) are no longer aligned and surface 32 makes contact with surface 30 (FIG. 1 or 2D). As illustrated, once the fork bolt is in the open position and the detent lever is biased back such that surface 32 contacts surface 30 (disengaged position) stop member 32 and its top surface are positioned such that further rotation of gear or actuator 46 in the direction of arrow 48 will cause protrusion 50 to contact top surface 56. The positioning of stop member 52 prevents protrusion 50 from continued rotation in the direction of arrow 48 and further movement of detent lever in a direction opposite of arrow 28A is prevented. In accordance with an exemplary embodiment of the present invention the detent lever and the fork bolt rotate in a similar plane or planes parallel or substantially parallel to each other while gear or actuator 46 rotates in a different plane, which in one non-limiting exemplary embodiment is perpendicular to the plane in which the fork bolt and the detent lever rotate.

Figure 3:
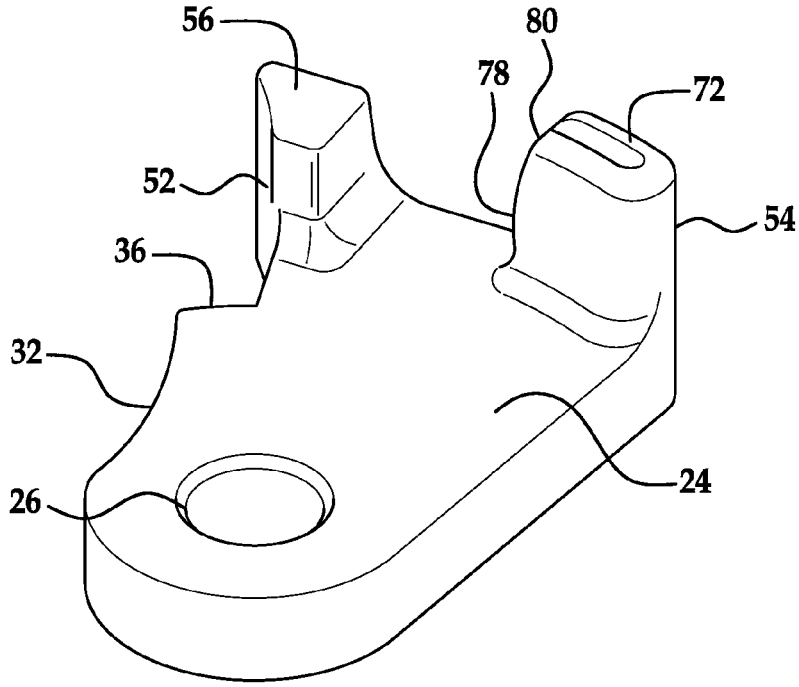
FIG. 3 is a perspective view of a detent lever of an exemplary embodiment of the present invention.

FIG. 3 provides an enlarged perspective view of detent lever 24. As illustrated, stop member 52 and guide member 54 protrude from a surface of the detent lever and a gap is provided therebetween so that protrusion 50 can rotate therein, when the detent lever is in the engaged position contact of the protrusion with the guide member will rotate the detent lever into the disengaged position. In accordance with an exemplary embodiment of the present invention, the stop member provides a limit of travel for the protrusion of the actuator or gear while also providing a means for limiting the amount of energy impacting the detent lever when the protrusion 50 is rotated and contact top surface 56 as will be discussed below. Furthermore, the guide member 54 provides a means for transferring the rotational force of the actuator or gear to the detent lever in order to overcome the biasing force provided to the detent lever.

Figure 4A:
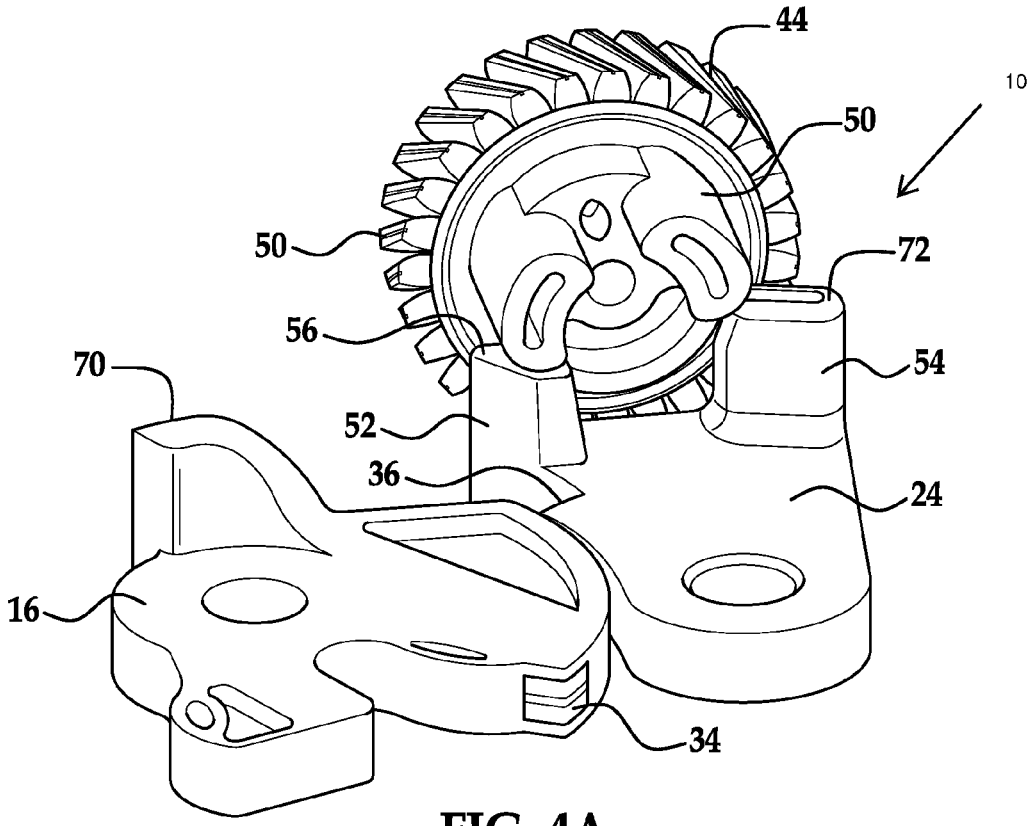
FIGS. 4A-4B illustrate movement of the gear or actuator of an exemplary embodiment of the present invention.
Figure 4B:
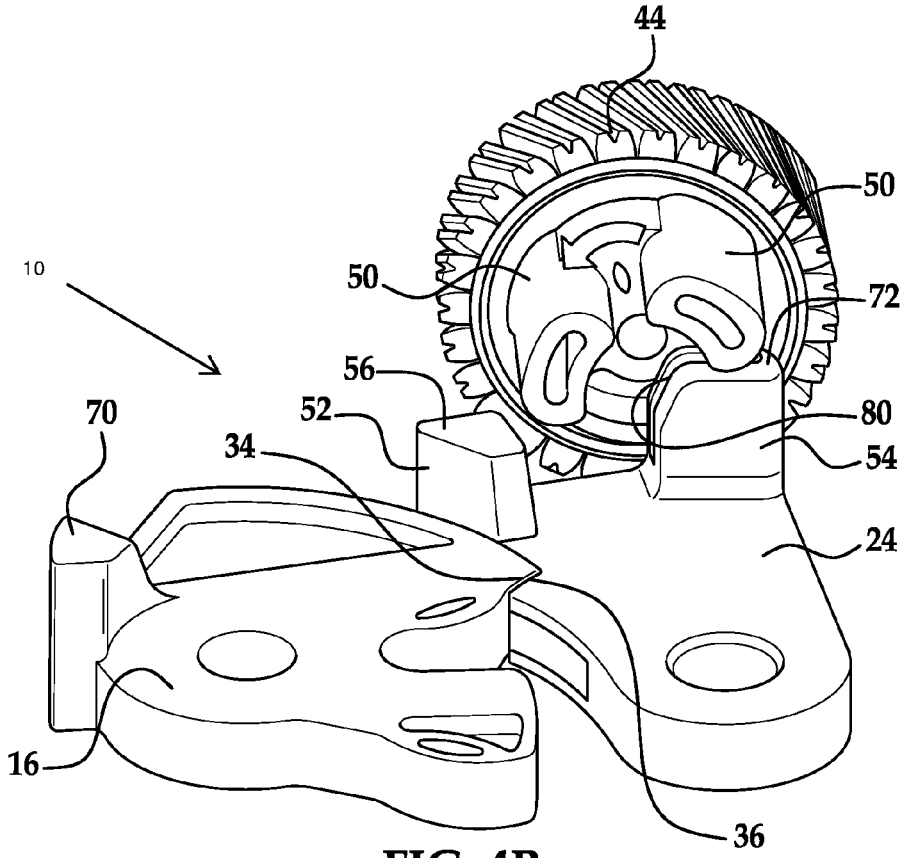

Referring now to FIGS. 1, 4A and 4B, rebounding movement of gear or actuator 46 is illustrated. During operation and as the gear is rotated in the direction of arrow 48, protrusion 50 will contact the top surface of stop member 52 if the fork bolt is in the open position and the detent lever is in the disengaged position. Further driving of the gear in the direction of arrow 48 may be limited by a microswitch 62 (illustrated schematically) that provides a signal to a controller 64 of the latch as will be described herein. Microswitch 62 is positioned to engage a cam surface 70 of the fork bolt such that rotation of the fork bolt from the closed position to the open position causes microswitch 62 to be actuated by the cam surface moving away and a signal is sent to the controller that controls the motor 42. In other words, during operation and when the motor drives the worm gear, rotates the actuator and protrusion 50 contacts guide member 54 the detent lever 24 is rotated from the engaged position to the disengaged position and fork bolt 16 rotates from the closed position to the open position, this rotation of the fork bolt causes the cam surface to either engage or no longer engage the microswitch which in turn causes the controller to turn the motor off as further driving of the actuator in the direction of arrow 48 will cause protrusion 50 to contact stop member 52.

Once the motor is the energized, gear member or actuator 46 is capable of rebounding back from stop member 52 in a direction opposite to arrow 48 wherein protrusion 50 no longer contacts the top surface of stop member 52. Two possible locations of protrusion 50 are illustrated in FIG. 4A. As illustrated, a range of rotation of actuator or gear member 46 is shown, one limit of this range of rotation is defined by protrusion 50 contacting stop member 52 and the other limit of this range of rotation is defined by protrusion 50 contacting guide member 54. Accordingly and if gear or actuator 46 rotates in a direction opposite to arrow 48 wherein protrusion 50 contacts a top surface 72 of the guide member thus limiting movement of the gear or actuator. In accordance with an exemplary embodiment of the present invention stop member 52 and guide member 54 and protrusion 50 are configured and positioned such that rotation of the gear member or actuator into the positions illustrated in FIG. 4A when detent lever is in the disengaged position, the protrusion 50 will contact the top surface of either stop member or the guide member.

Referring now to FIG. 4B, detent lever 24 is illustrated in the engaged position and fork bolt 16 is illustrated in the closed position such that shoulder portions 36 and 34 are engaged. Once again and when the motor is de-energized, gear member or actuator 46 is capable of rebounding back from its position between the stop member and the guide member wherein protrusion 50 is no longer positioned between the stop member and the guide member however, this range of movement is limited by the top surface of the guide member and a guide surface 78 of the guide member. Two possible locations of protrusion 50 are illustrated in FIG. 4B. As illustrated, a range of rotation of actuator or gear member of 46 is illustrated wherein one limit of the range of rotation is defined by the top surface 72 of guide member 54 and the other limit of the range of rotation is defined by a guide surface 78 of the guide member. In accordance with an exemplary embodiment of the present invention, stop member 52 and guide member 54 and protrusion 50 are configured and positioned such that rotation of the gear member or actuator into the positions illustrated in FIG. 4B when detent lever is in the engaged position the protrusion 50 will contact the top surface or guide surface of the guide member. Accordingly and when the motor is energized to drive the actuator or gear in the direction of arrow 48 protrusion 50 is free to rotate until it contacts guide surface 78 and moves the detent lever from the engaged position to the disengaged position.

Figure 4C:
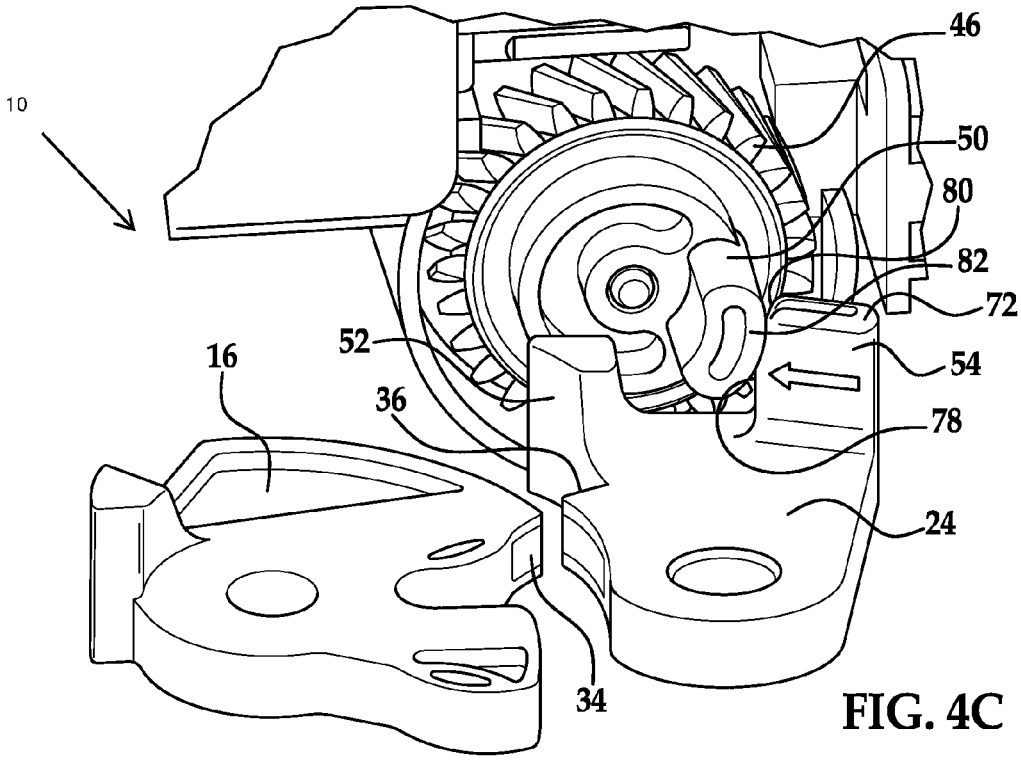
FIG. 4C is a perspective view illustrating an alternative exemplary embodiment.

Referring now to FIG. 4C, yet another feature of an exemplary embodiment of the present invention is illustrated. Here gear or actuator 46 is illustrated in a position wherein protrusion 50 has not fully traveled past guide member 54 and detent lever is in the disengaged position. In order to prevent protrusion 50 and gear member 46 from being stuck in this position, a cam surface 80 is position between guide surface 78 and top surface 72 of guide member 54. Furthermore, protrusion 50 is configured to have a "kidney" shape such that a curved exterior surface 82 will contact cam surface 80 and the biasing force in a direction of arrow 28A will cause gear or actuator 46 to rotate in the direction of arrow 48 such that protrusion 50 is not stuck in the position illustrated in FIG. 4C.

Figure 5A:
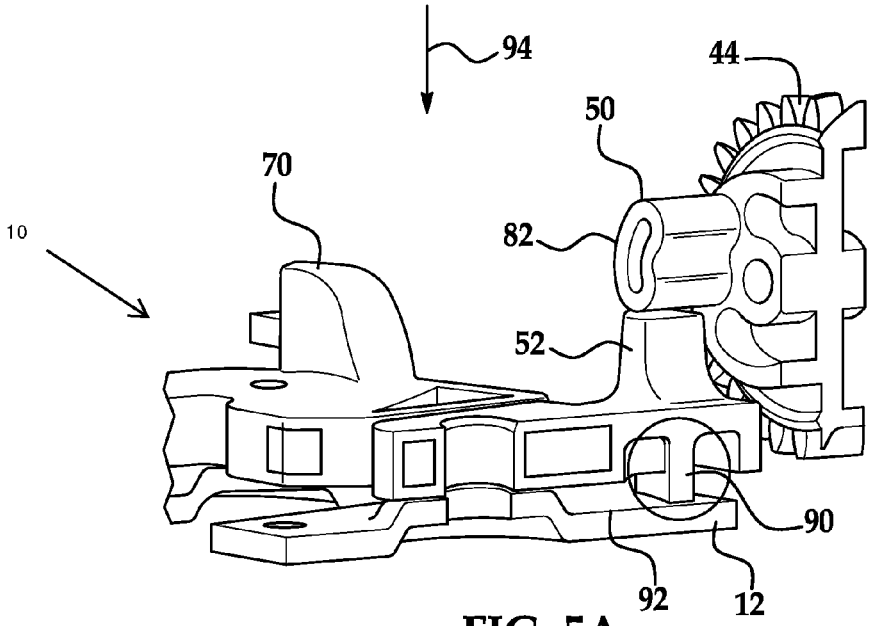
FIGS. 5A and 5B are cross-sectional views illustrating still another alternative exemplary embodiment of the present invention.
Figure 5B:
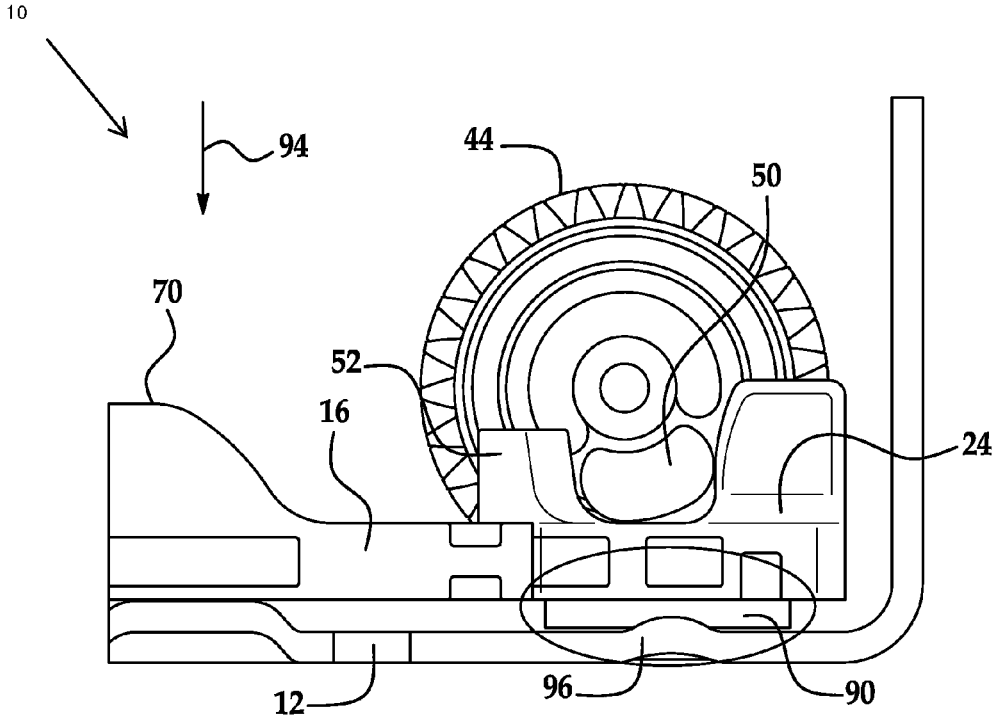

Referring now to FIGS. 5A-5B, alternative exemplary embodiments of the present invention are illustrated. Here a lower surface of the detent lever is illustrated. Since the fork bolt and the detent lever rotate in a similar plane or planes that are parallel to each other while the actuator or gear rotates in a plane that is not parallel to the plane in which the fork bolt and the detent lever rotate (e.g., perpendicular or otherwise), rotational forces of the actuator may be imparted to the detent lever and accordingly stabilizing features may be required. In FIG. 5A, the lower surface of detent lever 24 further comprises a stabilizing feature 90 that extends from the bottom surface of detent lever 24 and is in a facing spaced relationship with respect to a surface 92 of support 12 such that during rotational movement of the detent lever 24 stabilizing feature 90 does not contact surface 92 however, if the detent lever is in the disengaged position (e.g., fork bolt in the open position) protrusion 50 may contact the top surface of stop member 52 as discussed above. In order to prevent the power driven gear member and protrusion 50 from continuously forcing the detent lever downward in a direction of arrow 94 such that detent lever 24 may be damaged or permanently deflected, stabilizing feature 90 is positioned such that minimal movement of the detent lever downward in the direction of arrow 94 will cause the same to contact surface 92 thus causing the applied forces of protrusion 50 to be directly applied to support 12 as opposed to damaging detent lever 24.

Referring now to FIG. 5B the support is configured to have a protrusion or feature 96 that protrudes away from surface 92 of the support. This feature will also provide stabilization or support when protrusion 50 pushes against detent lever 24 downward in the direction of arrow 94. Accordingly, stabilizing feature 90 and protrusion 96 provide a means for providing a load path from protrusion 50 to support 12 without adversely affecting the rotational plane upon which detent lever 24 rotates. It being understood that stabilizing feature 90 and protrusion 96 may be used together or alone or with the aforementioned embodiments. Moreover, feature 90 and protrusion 96 can be aligned with each other or off set from each other. Alternatively, the latch assembly is constructed without feature 90 and 96.

Referring back now to FIGS. 1 and 2 and when the latch assembly is opened, the movement of the gear or actuator is limited by a physical stop located in the detent lever (e.g., the top surface of the stop member). At this position and if the motor of the latch assembly is turned on, the gear or actuator won't be able to move since the protrusion 50 will contact the top surface of the stop member. When the latch assembly is in the closed position, the detent lever will rotate clockwise (FIG. 2) and the physical stop will move so that it is no longer in a blocking position with respect to the protrusion of the gear and the motor of the latch assembly can now be turned on wherein the gear will rotate and the protrusion will advance until it contacts the guide member thereby moving the detent lever from the engaged position to the disengaged position. This movement of the detent lever releases the fork bolt and the same is now capable of rotating from the closed position to the open position. Once again with the fork bolt in the open position in the detent lever and the disengaged position, the physical stop or stop member of the detent will block further rotation of the gear or actuator.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch assembly, comprising:

a fork bolt movably secured to the latch assembly, the fork bolt being capable of movement between a latched position and an unlatched position;

a detent lever movably secured to the latch assembly, the detent lever being capable of movement between an engaged position and a disengaged position, the detent lever retains the fork bolt in the latched position when the detent lever is in the engaged position and the detent lever has a stop member and a guide member each protruding away from a surface of the detent lever, the stop member being in a spaced relationship with respect to the guide member; and an actuator for moving the detent lever from the engaged position to the disengaged position by contacting the guide member, the stop member being positioned so that the actuator will contact the stop member and prevent further movement of the actuator when the fork bolt is in the unlatched position and the detent lever is in the disengaged position, wherein at least a portion of the detent lever and at least a portion the fork bolt rotate in a similar plane and the actuator rotates in a plane that is not parallel to the plane in which the portion of the fork bolt and the portion of the detent lever rotate and the guide member and the stop member extend away from the detent lever in a direction parallel to the plane the actuator rotates in, wherein the actuator is coupled to a motor configured to move the actuator.

2. The latch assembly as in claim 1, wherein the actuator rotates in a plane that is orthogonal with respect to the plane in which the portion of the detent lever rotates.

3. The latch assembly as in claim 1, further comprising a microswitch positioned to engage a cam surface of the fork bolt as the fork bolt rotates between the unlatched position and the latched position.

4. The latch assembly as in claim 3, wherein the microswitch provides a signal to a controller when the fork bolt is in the unlatched position and the cam surface engages the micro switch.

5. The latch assembly as in claim 1, wherein the detent lever further comprises a stabilizing feature for limiting of movement of the detent lever when the actuator engages the stop member.

6. The latch assembly as in claim 1, wherein the actuator is a gear comprising an integrally formed protrusion configured to engage the stop member and the guide member of the detent lever.

7. The latch assembly as in claim 6, wherein the protrusion has a curved peripheral surface configured to engage a cam surface of the guide member.

8. The latch assembly as in claim 1, wherein the actuator is a gear rotationally actuated by the motor and the gear further comprises an integrally formed protrusion configured to engage the stop member and the guide member of the detent lever, wherein the stop member and guide member are configured such that rotational movement of the gear in a first direction is prevented when the detent lever is in the disengaged position and the protrusion contacts the stop member.

9. A method of operating a latch assembly, the method comprising:

rotating a fork bolt into a latched position from an unlatched position;

engaging a detent lever with the fork bolt when the fork bolt is in the latched position;

releasing the detent lever from the fork bolt by rotating an actuator with a motor until it engages a guide member of the detent lever and moves the detent lever into a disengaged position with respect to the fork bolt;

rotating the fork bolt from the latched position to the unlatched position; and preventing the actuator from contacting the guide member by locating a stop member of the detent lever such that rotation of the actuator in a first direction is limited by the stop member when the detent lever is in the disengaged position, wherein at least a portion of the detent lever and at least a portion of the fork bolt rotate in a similar plane and the actuator rotates in a plane that is not parallel to the plane in which the portion of the fork bolt and the portion of the detent lever rotate and the guide member and the stop member extend away from the detent lever in a direction parallel to the plane the actuator rotates in.

10. The method as in claim 9, wherein the actuator rotates in a plane that is orthogonal with respect to the plane in which the portion of the detent lever rotates.

11. The method as in claim 9, further comprising a microswitch positioned to engage a cam surface of the fork bolt as the fork bolt rotates from the unlatched position to the latched position, wherein the microswitch provides a signal to a controller when the fork bolt is in the unlatched position and the cam surface engages the micro switch.

12. The method as in claim 9, wherein the detent lever further comprises a stabilizing feature for limiting movement of the detent lever when the actuator engages the stop member.

13. The method as in claim 9, wherein the actuator is a gear comprising an integrally formed protrusion configured to engage the stop member and the guide member of the detent lever.

14. The method as in claim 13, wherein the protrusion has a curved peripheral surface configured to engage a cam surface of the guide member.

15. The method as in claim 9, wherein the actuator is a gear rotationally actuated by the motor and the gear further comprises an integrally formed protrusion configured to engage the stop member and the guide member of the detent lever, wherein the stop member and guide member are configured such that rotational movement of the gear in a first direction is prevented when the detent lever is in the disengaged position and the protrusion contacts the stop member.

* * * * *